US008523175B2

(12) United States Patent
Kobayashi et al.

(10) Patent No.: US 8,523,175 B2
(45) Date of Patent: Sep. 3, 2013

(54) SHEET TRANSPORT APPARATUS AND IMAGE FORMING APPARATUS INCLUDING THE SAME

(75) Inventors: Yoshiyuki Kobayashi, Osaka (JP); Masaharu Kimura, Osaka (JP); Kohji Aoki, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 13/296,430

(22) Filed: Nov. 15, 2011

(65) Prior Publication Data

US 2012/0119431 A1 May 17, 2012

(30) Foreign Application Priority Data

Nov. 16, 2010 (JP) ..... 2010-256199

(51) Int. Cl.
*B65H 29/70* (2006.01)

(52) U.S. Cl.
USPC ..... 271/188; 271/902

(58) Field of Classification Search
USPC ..... 271/188, 902, 209, 243, 245, 225; 399/399, 401, 406
See application file for complete search history.

(56) References Cited

U.S. PATENT DOCUMENTS

| | | | | |
|---|---|---|---|---|
| 5,312,108 | A * | 5/1994 | Hayashi | 271/188 |
| 5,727,784 | A * | 3/1998 | Sagawa | 271/265.01 |
| 5,947,467 | A * | 9/1999 | Billings et al. | 271/188 |
| 6,000,866 | A * | 12/1999 | Funaki et al. | 400/120.01 |
| 6,698,752 | B1 * | 3/2004 | Kakuta et al. | 271/188 |
| 2004/0201166 | A1 * | 10/2004 | Butterfass et al. | 271/245 |
| 2010/0276863 | A1 * | 11/2010 | Yano | 271/3.14 |
| 2011/0285080 | A1 * | 11/2011 | Gendreau et al. | 271/270 |
| 2012/0038101 | A1 * | 2/2012 | Osaki | 271/209 |

FOREIGN PATENT DOCUMENTS

| | | | |
|---|---|---|---|
| JP | 2000-318904 | A | 11/2000 |
| JP | 2001-226016 | A | 8/2001 |
| JP | 2002-220160 | A | 8/2002 |
| JP | 2004-043083 | A | 2/2004 |
| JP | 2006-151617 | A | 6/2006 |

* cited by examiner

*Primary Examiner* — Jeremy R Severson
(74) *Attorney, Agent, or Firm* — Birch, Stewart, Kolasch & Birch, LLP

(57) ABSTRACT

A sheet transport apparatus includes a sheet transport portion that transports a sheet in a first transport direction and a second transport direction, a bending member that bends without breaking the sheet by corrugating the sheet in an orthogonal direction, and a restriction member that restricts, in a perpendicular direction, a corrugation in the sheet bent by the bending member. The restriction member is provided on an upstream side in the first transport direction of the bending member.

13 Claims, 7 Drawing Sheets

SHEET TRANSPORT APPARATUS AND IMAGE FORMING APPARATUS INCLUDING THE SAME

BACKGROUND OF THE INVENTION

This application claims priority under 35 U.S.C. §119(a) on Patent Application No. 2010-256199 filed in Japan on Nov. 16, 2010, the entire contents of which are herein incorporated by reference.

1. FIELD OF THE INVENTION

The present invention relates to a sheet transport apparatus applicable to an image forming apparatus such as a printer, copier, multifunctional peripheral, and the like, and an image forming apparatus.

2. DESCRIPTION OF THE RELATED ART

In conventional sheet transport apparatuses for transporting a sheet such as recording paper, there is known to be a sheet transport apparatus including a sheet transport portion for transporting a sheet both in a first transport direction and a second transport direction that is opposite to the first transport direction (e.g., see JP 2002-220160A (hereinafter referred to as "Patent Document 1")).

Such a sheet transport apparatus is generally provided on the downstream side in the second transport direction of the sheet transport portion, and is often applied to an image forming apparatus including a curved transport path in which the transport path is curved along the transport direction.

An image forming apparatus including a sheet transport apparatus having a sheet transport portion that transports a sheet both in the first transport direction and the second transport direction, and a curved transport path provided on the downstream side in the second transport direction of the sheet transport portion is typically used as an image forming apparatus that is capable of image formation on both sides of the sheet and that includes a discharge configuration in which a sheet is transported in the first transport direction in the sheet transport portion and is discharged to the outside, and a switchback configuration in which a sheet transported in the first transport direction in the sheet transport portion is transported in the second transport direction by a switchback operation so as to be transported to the curved transport path, the front and back sides of the sheet are inverted through that transport, and the sheet is guided to the upstream side of an image forming portion (specifically, registration rollers).

In some conventional sheet transport apparatuses as described above, from the viewpoint of improving stacking quality of sheets on a discharge tray, a bending member is provided that corrugates the sheet in an orthogonal direction that is orthogonal to the transport direction of the sheet transported in the sheet transport portion and conforms to the sheet surface, and thereby bends without breaking the sheet (e.g., see JP 2006-151617A (hereinafter referred to as "Patent Document 2")).

However, with a sheet transport apparatus provided with the bending member for bending a sheet by corrugating the sheet transported in the sheet transport portion in the orthogonal direction that is orthogonal to the transport direction of the sheet and conforms to the sheet surface, in a case where the sheet is guided to a curved transport path that is curved in the transport direction, since the sheet has corrugations, there is a problem that an abnormal sound occurs when the sheet is transported in the curved transport path.

FIG. 6 is a diagram illustrating an example of a sheet transport apparatus A1 in which bending rollers B3 serving as a bending member, and a bending guide portion B4 are provided, and is a schematic side view of the transportation state of a sheet P as seen from a transport direction Y thereof.

The sheet transport apparatus A1 shown in FIG. 6 includes a plurality of first transport rollers B1 arranged on the same axis, and a plurality of second transport rollers B2 that are arranged on the same axis so as to oppose the first transport rollers B1, and a sheet transport portion A2 in which the sheet P is transported held between the first transport rollers B1 (drive rollers fixed on a drive roller shaft E1) that are driven to rotate and the second transport rollers B2 (idler rollers fixed on an idler roller shaft E2) that are driven due to the rotation of the first transport rollers B1.

In the sheet transport portion A2, bending rollers B3 are arranged on the same axis as the first transport rollers B1. The bending rollers B3 each have a diameter larger than that of the first transport rollers B1, and are configured to rotate integrally with the first transport rollers B1 (in the example shown in FIG. 6, fixed on the drive roller shaft E1).

Also, the sheet transport apparatus A1 includes the bending guide portion B4 that is fixed to the sheet transport portion A2 and corrugates the transported sheet P in an orthogonal direction X that is orthogonal to the transport direction Y and conforms to the sheet surface, thereby bending the sheet P. The bending guide portion B4 is arranged at the central position in the orthogonal direction X of the transported sheet P, and bends without breaking mainly sheets P such as a small size sheet, an envelope, and the like, which do not reach the bending rollers B3 when they are transported in a central portion in the orthogonal direction X by the transport rollers B1 and B2.

However, in the sheet transport apparatus Al, there is a problem relating to corrugations formed in the sheet P by the bending rollers B3 and the bending guide B4, in particular, a problem that in the case where the sheet P is guided to a curved transport path D (see FIG. 7 described below) that is curved along the transport direction Y of the sheet P, an abnormal sound occurs due to the sheet P corrugated in the orthogonal direction X being transported in the curved transport path D that is curved in the transport direction Y.

FIG. 7 is a schematic cross-sectional view illustrating, in an example of the sheet transport apparatus A1, a state in which the sheet P corrugated in the orthogonal direction X that is orthogonal to the transport direction Y and conforms to the sheet surface is transported in the curved transport path D that is curved along the transport direction Y, as seen from the orthogonal direction X.

As shown in FIG. 7, when the sheet P transported (transported by the switchback operation) in a second transport direction Y2 by the transport rollers B1 and B2 rotated in reverse by a switch-back function is guided to the curved transport path D (in this example, a reverse transport path for inverting the front and back sides of the sheet P that is used when images are formed on both sides), the sheet P corrugated in the orthogonal direction X is forcibly bent while it is transported on the curved transport path D that is curved along the transport direction Y, and corrugations in the sheet P are restored to the original condition as a result of the sheet P having been bent. When the corrugations in the sheet P are restored to the original condition, an abnormal sound (specifically, a crunching sound, for example) may occur.

This is particularly noticeable in a configuration in which the sheet P is moved to the curved transport path D while having relatively large corrugations therein (specifically, a small-sized image forming apparatus in which the distance from the bending rollers B3 and the bending guide portion B4 to the curved transport path D is relatively short). Furthermore, when the height of the bending guide portion B4 is increased to form larger corrugations, although stacking quality on a discharge tray B5 can be improved mainly for sheets P such as a small size sheet, an envelope, and the like, the problem occurs that an abnormal sound readily occurs when the sheet P corrugated by the bending guide portion B4 is transported in the curved transport path D, due to the increased height.

In this respect, Patent Document 1 discloses a configuration in which curl in the sheet is corrected in the curved transport path. However, Patent Document 1 does not disclose a configuration which solves an abnormal sound that occurs when the corrugated sheet is transported in the curved transport path.

Also, Patent Document 2 discloses a configuration in which a bending roller and a transport roller are integrally rotated when a sheet is discharged, and at the time of reverse rotation, the bending roller is not rotated integrally with the transport roller, but is driven by the sheet. However, with the configuration disclosed in Patent Document 2, although the bending roller is driven by the sheet at the time of reverse rotation, it does not suppress the corrugations in the sheet. Thus, with this configuration as well, an abnormal sound that occurs when the sheet is transported in the curved transport path is not solved.

In view of this, the present invention aims to provide a sheet transport apparatus that is capable of suppressing occurrence of problems relating to corrugations formed in the sheet by the bending member (in particular, an abnormal sound that occurs when the sheet is transported in the curved transport path), while securing high stacking quality of sheets, and an image forming apparatus including such a sheet transport apparatus.

SUMMARY OF THE INVENTION

In order to solve the above-described problems, the present invention provides a sheet transport apparatus including a sheet transport portion that transports a sheet in a first transport direction and a second transport direction that is opposite to the first transport direction; a bending member that bends without breaking the sheet by corrugating the sheet in an orthogonal direction that is orthogonal to the transport direction of the sheet and conforms to a surface of the sheet; and a restriction member that restricts, in a perpendicular direction that is orthogonal to both the first transport direction and the second transport direction, and the orthogonal direction, a corrugation in the sheet bent by the bending member, wherein the restriction member is provided on an upstream side in the first transport direction of the bending member. In the above-described configuration, the restriction member may be provided on the upstream side in the first transport direction of a tip in the perpendicular direction of the bending member.

Also, the present invention provides an image forming apparatus including the sheet transport apparatus according to the present invention; a curved transport path provided on a downstream side in the second transport direction of the sheet transport portion of the sheet transport apparatus; and a discharge configuration in which the sheet transport portion transports a sheet in the first transport direction and discharges a sheet to the outside, and a transport configuration in which the sheet transport portion transports a sheet in the second transport direction toward the curved transport path.

With the present invention, the restriction member that restricts corrugations in a sheet (specifically, recording paper or an original) bent by the bending member in the perpendicular direction is provided on the upstream side in the first transport direction (specifically, the direction in which the sheet is discharged onto a discharge tray) of the bending member (a specific example is the tip of the bending member in the perpendicular direction). Thus, it is possible to maintain corrugations formed by the bending member in the sheet transported (specifically, discharged) in the first transport direction from the restriction member, and also to reduce corrugations formed by the bending member in the sheet transported in the second transport direction (specifically, the direction toward a curved transport path curved in the transport direction, for example, the curved transport path in the image forming apparatus of the present invention). In this manner, it is possible to suppress occurrence of problems relating to corrugations in the sheet formed by the bending member (particularly, an abnormal sound that occurs when the sheet is transported in the curved transport path), while securing high stacking quality of sheets.

In the present invention, an aspect is possible in which the restriction member is provided opposing the bending member in at least one of the orthogonal direction and the perpendicular direction. Specific examples of this aspect include an aspect in which the restriction member overlaps the bending member in the orthogonal direction, an aspect in which the restriction member overlaps the bending member in the perpendicular direction, and an aspect in which the restriction member overlaps the bending member both in the orthogonal direction and the perpendicular direction.

With this specific matter, since the restriction member is provided opposing the bending member in at least one of the orthogonal direction and the perpendicular direction, it is possible to reliably reduce corrugations in the sheet that is transported in the second transport direction from the restriction member, the corrugations being in a position corresponding to the position of the bending member.

In the present invention, it is preferable that the sheet transport portion includes a pair of transport rollers for transporting the sheet, and the restriction member is provided on the upstream side in the first transport direction of a nip portion of the pair of transport rollers.

With this specific matter, since the restriction member is provided on the upstream side in the first transport direction of the nip portion of the pair of transport rollers, it is possible to, for example, prevent the restriction member from inhibiting the force with which the sheet is transported (specifically, discharged onto the discharge tray) in the first transport direction from the sheet transport portion to the outside. Therefore, it is possible to reliably transport a sheet in the first transport direction, and prevent deterioration of stacking quality of the sheet.

In the present invention, an aspect is possible in which the restriction member is a flexible member having elasticity that is smaller than a force with which the sheet transport portion transports the sheet.

With this specific matter, with the restriction member formed as a flexible member, it is possible for the restriction member to be bent allowing for an appropriate elasticity and thereby restrict the corrugation in the sheet, while keeping transportability of the sheet bent by the bending member.

In the present invention, an aspect is possible in which the restriction member is a sheet-shaped flexible member.

With this specific matter, by forming the restriction member as a sheet-shaped flexible member, it is possible to readily achieve both transportability of a sheet and an effect of restricting the corrugation in the sheet with an inexpensive and simple structure.

In the present invention, an aspect is possible in which at least a portion of the restriction member that comes into contact with the sheet is formed with a fluororesin. Note that a typical example of fluororesin is polytetrafluoroethylene.

With this specific matter, since at least a portion of the restriction member formed as the flexible member, the portion coming into contact with the sheet, is formed with a fluororesin, and the fluororesin generally has a friction coefficient that is much lower than that of the sheet, it is possible to reduce or eliminate a sound generated by the restriction member and the sheet rubbing against each other.

Here, the friction coefficient is a concept including both static friction coefficient and dynamic friction coefficient. That is, in the case where the friction coefficient of the fluororesin is a static friction coefficient, the friction coefficient of the sheet is also a static friction coefficient, and in the case where the friction coefficient of the fluororesin is a dynamic friction coefficient, the friction coefficient of the sheet is also a dynamic friction coefficient.

Also, in a case where the restriction member is a sheet-shaped flexible member, it is preferable that the restriction member formed as a sheet-shaped flexible member is made of a fluororesin.

With this specific matter, since the restriction member is formed as a sheet-shaped flexible member made of a fluororesin, it is possible to reduce or eliminate a sound generated by the restriction member and the sheet rubbing against each other, while readily achieving both transportability of a sheet and an effect of restricting the corrugation in the sheet with an inexpensive and simple structure.

In the present invention, it is preferable that the restriction member overlaps the bending member in the orthogonal direction, and secures a path for the sheet by allowing for elastic deformation due to transport of the sheet in the first transport direction.

With this specific matter, by adopting a configuration in which the restriction member that overlaps the bending member in the orthogonal direction allows for elastic deformation thereof due to transport of the sheet in the first transport direction, thereby securing a path for the sheet, it is possible to prevent the restriction member from obstructing transport of the sheet, and it is thereby possible to prevent occurrence of a jam (sheet jam).

As a specific aspect of the above-described configuration, an aspect is possible in which the restriction member includes a first opposing portion that opposes an end portion of the bending member that is on one side in the orthogonal direction in a contactless manner when the restriction member undergoes elastic deformation due to transport of the sheet in the first transport direction, and a second opposing portion that opposes an end portion of the bending member that is on the other side in the orthogonal direction in a contactless manner when the restriction member undergoes elastic deformation due to transport of the sheet in the first transport direction.

With this specific matter, in the restriction member, when it undergoes elastic deformation due to transport of the sheet in the first transport direction, the first opposing portion opposes an end portion of the bending member on one side in the orthogonal direction in a contactless manner, and the second opposing portion opposes an end portion of the bending member on the other end in the orthogonal direction in a contactless manner, and thus it is possible to reliably secure a path for the sheet transported in the first transport direction.

In the present invention, an aspect is possible in which the sheet transport portion includes a pair of transport rollers for transporting the sheet, and is configured to transport the sheet in a horizontal direction, diagonally upward or diagonally downward, the tip of the bending member is provided on a downstream side in the first transport direction of a nip portion of the pair of transport rollers, and the bending member is configured to bend a transported sheet by corrugating the transported sheet in the orthogonal direction from above, and the restriction member is configured to restrict the corrugation from below the sheet.

With this specific matter, a configuration is adopted in which the sheet transport portion transports a sheet in the horizontal direction, diagonally upward or diagonally downward, and even if the tip of the bending member is provided on the downstream side in the first transport direction of the nip portion of the pair of transport rollers, the bending member corrugates a sheet transported in the sheet transport portion from above and thereby bends without breaking the sheet. Therefore, for example, it is possible to prevent the bending member from inhibiting the force with which the sheet is transported (specifically, discharged onto the discharge tray) in the first transport direction from the sheet transport portion to the outside, and consequently it is possible to reliably transport the sheet in the first transport direction, and prevent deterioration of stacking quality of sheets.

In the present invention, an aspect is possible in which the sheet transport apparatus includes a plurality of first transport rollers provided on a same axis, a plurality of second transport rollers that are provided opposing the plurality of first transport rollers and on a same axis, a pair of transport rollers configured to transport the sheet while holding the sheet between the first transport rollers and the second transport rollers that are rotated, a bending roller that is provided on the same axis as that of at least one of the first transport rollers and the second transport rollers, and has a diameter larger than that of the transport rollers provided on the same axis as that of the bending roller, and a bending guide portion provided in a central position of a transported sheet in the orthogonal direction, and the restriction member restricts the corrugation in the sheet bent by the bending guide portion out of the bending roller and the bending guide portion.

With this specific matter, the corrugation in the sheet can be reduced with the restriction member that restricts the corrugation in the sheet that has been bent by the bending guide portion arranged in the central position, and in this manner, mainly, it is possible to suppress occurrence of problems relating to the corrugation in the sheet formed by the bending member (particularly, an abnormal sound that occurs when the sheet is transported in the curved transport path), while securing high stacking quality of sheets such as small size paper, an envelope and the like.

BRIEF DESCRIPTION OF THE DRAWINGS

FIG. 5 includes FIGS. 5A, 5B, 5C and 5D, each schematically illustrating a configuration in which although a restriction member overlaps a bending guide portion in the orthogonal direction, the restriction member allows for elastic deformation thereof due to transport of paper in the first transport direction, thereby securing a path for the paper.

DESCRIPTION OF REFERENCE NUMERALS

Figure 1:
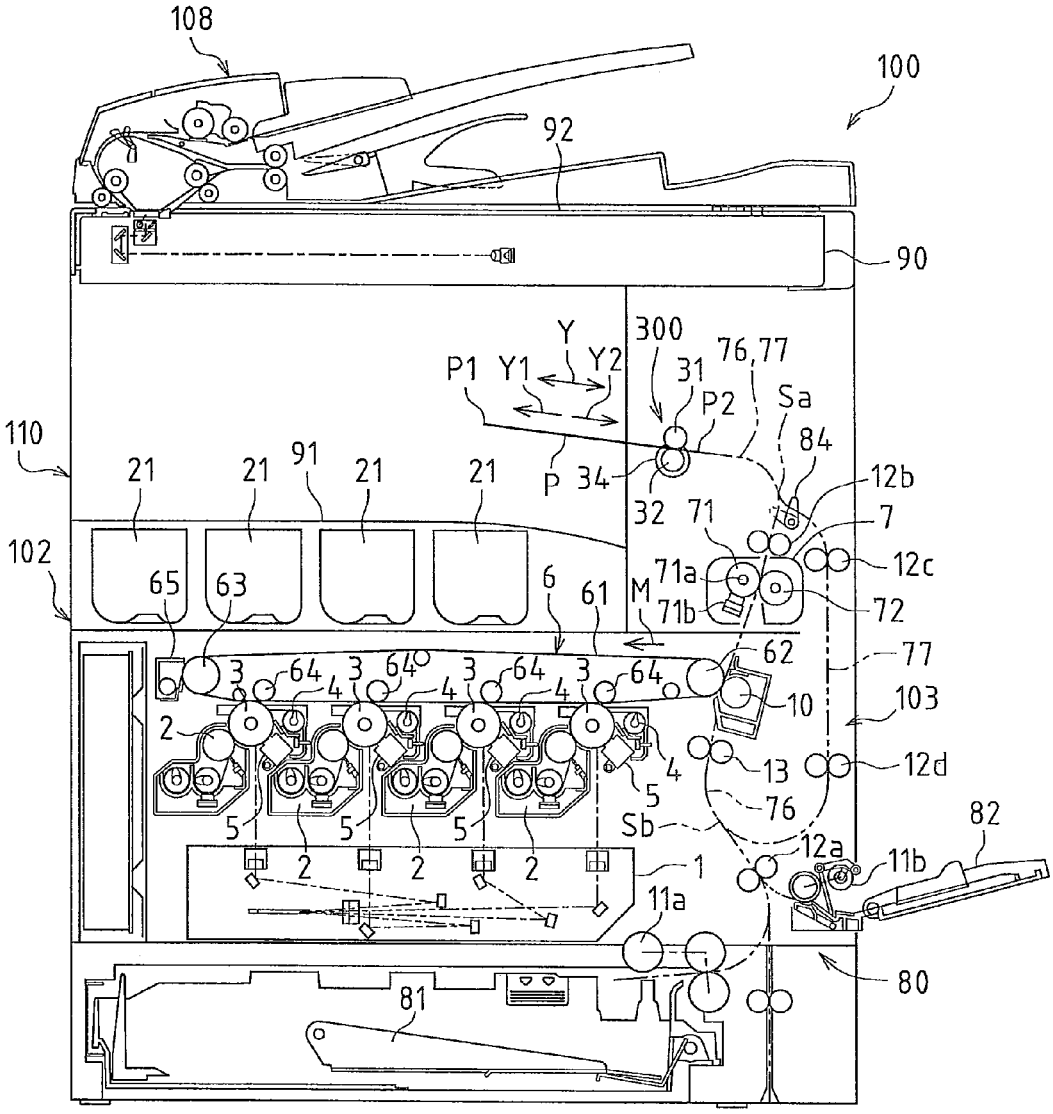
FIG. 1 is a schematic cross-sectional view of an image forming apparatus including a sheet transport apparatus according to an embodiment of the present invention as seen from the front.

30 Sheet transport portion
31 First discharge rollers
31*a* Drive roller shaft
32 Second discharge rollers
32*a* Idler roller shaft
34 Bending roller (example of the bending member)
40 Rotation drive portion
77 Reverse transport path (example of the curved transport path)
100 Image forming apparatus
210 Bending guide portion (example of the bending member)
211 Upstream side end
212 Downstream side end
213 Tip
214 End face
215 End face
220 Restriction member
221 First opposing portion
222 Second opposing portion
223 Recessed portion
300 Sheet transport apparatus
N Nip portion
P Paper (example of the sheet)
X Orthogonal direction
Y Transport direction
Y1 First transport direction
Y2 Second transport direction
Z Perpendicular direction
β Central position

DETAILED DESCRIPTION OF THE INVENTION

Hereinafter, embodiments of the present invention will be described based on the accompanying drawings. The embodiments described below are only examples in which the present invention is embodied, and are not intended to limit the technical scope of the present invention.

Description of Overall Configuration of Image Forming Apparatus

FIG. 1 is a schematic cross-sectional view of an image forming apparatus 100 including a sheet transport apparatus 300 according to an embodiment of the present invention as seen from the front.

The image forming apparatus 100 shown in FIG. 1 is a color image forming apparatus that forms images in multiple colors or in a single color on a sheet (hereinafter referred to as "paper") P such as recording paper in accordance with image data transmitted from the outside. The image forming apparatus 100 includes an original reading apparatus 108 and an apparatus main body 110, and the apparatus main body 110 is provided with an image forming portion 102 and a sheet transport system 103.

The image forming portion 102 includes an exposure unit 1, a plurality of development units 2, a plurality of photosensitive drums 3, a plurality of cleaning portions 4, a plurality of charging devices 5, an intermediate transfer belt unit 6, a plurality of toner cartridge units 21, and a fixing unit 7.

Moreover, the sheet transport system 103 includes a paper feed portion 80 that includes a paper feed tray 81 and a manual paper feed tray 82, below-described transport paths (a main transport path 76 and a reverse transport path 77), and a paper discharge tray 91.

An original platen 92 composed of a transparent glass on which an original (a sheet) can be placed is provided in an upper portion of the apparatus main body 110, and an optical unit 90 for reading the original is provided below the original platen 92. Moreover, the original reading apparatus 108 is provided above the original platen 92. The original reading apparatus 108 automatically transports the original onto the original platen 92. Moreover, the original reading apparatus 108 is pivotably attached to the apparatus main body 110 so that a front side thereof can be opened, and it is possible to manually place the original there by uncovering an upper surface of the original platen 92.

The original reading apparatus 108 can read originals that are automatically transported or originals that have been placed on the original platen 92. An entire image of an original that has been read by the original reading apparatus 108 is sent to the apparatus main body 110 of the image forming apparatus 100 as image data. Then, in the apparatus main body 110, an image is formed based on the image data and recorded on paper P.

The image data handled in the image forming apparatus 100 corresponds to a color image using a plurality of colors (here, the colors of black (K), cyan (C), magenta (M), and yellow (Y)). Therefore, more than one (here, four, respectively corresponding to black, cyan, magenta, and yellow) of the development units 2, the photosensitive drums 3, the cleaning portions 4, the charging devices 5, and the toner cartridge units 21 are provided, so that a plurality of types (here, four types) of images corresponding to individual colors are formed, and these units constitute a plurality of (here, four) image stations.

The charging devices 5 serve as charging means for uniformly charging the surface of photosensitive drums 3 at a predetermined electric potential. In addition to a charger-type charging device as shown in FIG. 1, a roller-type charging device or a brush-type charging device, which are of a contact-type, can be used.

The exposure unit 1 is configured as a laser scanning unit (LSU) including a laser emitting portion and a reflection mirror. The exposure unit 1 is provided with a polygon mirror that scans a laser beam and optical elements, such as a lens and a mirror, for guiding laser light that has been reflected by this polygon mirror to the photosensitive drums 3. Moreover, concerning the exposure unit 1, other techniques can also be adopted in which, for example, EL (electroluminescence) or a write head having an array of light emitting elements such as LEDs (light emitting diodes) is used.

The exposure unit 1 exposes each of the charged photosensitive drums 3 in accordance with the image data that has been input, thereby forming electrostatic latent images corresponding to the image data on the surfaces of the respective photosensitive drums 3.

The toner cartridge units 21 are units that accommodate toners, and are adapted to supply the toners to development tanks of the development units 2. In the apparatus main body 110 of the image forming apparatus 100, the toners supplied from the toner cartridge units 21 to the development tanks of the development units 2 are controlled so as to keep the toner concentrations in developers in the development tanks constant.

The development units 2 make the electrostatic latent images formed on the respective photosensitive drums 3 visible using the four colors (Y, M, C, and K) of toners. Moreover, the cleaning portions 4 remove and collect residual toner on the surfaces of the photosensitive drums 3 after developing and transferring the images The intermediate transfer belt unit 6 disposed above the photosensitive drums 3 includes an intermediate transfer belt 61 that acts as an intermediate transfer member, an intermediate transfer belt drive roller 62, an intermediate transfer belt idler roller 63, a plurality of intermediate transfer rollers 64, and an intermediate transfer belt cleaning unit 65.

Four rollers are provided as the intermediate transfer rollers 64 for the colors Y, M, C, and K, respectively. The intermediate transfer belt drive roller 62, together with the intermediate transfer belt idler roller 63 and the intermediate transfer rollers 64, stretches the intermediate transfer belt 61 in a tensioned manner, and when the drive roller is driven to rotate, the intermediate transfer belt 61 is moved around in a moving direction (the direction of arrow M in FIG. 1), and with this movement, the idler roller 63 and the intermediate transfer rollers 64 are rotated.

A transfer bias for transferring the toner images formed on the photosensitive drums 3 onto the intermediate transfer belt 61 is applied to each of the intermediate transfer rollers 64.

The intermediate transfer belt 61 is provided in contact with the photosensitive drums 3. The toner images that have been formed on the photosensitive drums 3 in respective colors are sequentially transferred onto the intermediate transfer belt 61 in such a manner that the toner images are superimposed on top of one another, and thus, a color toner image (a multi-color toner image) is formed on the surface of the belt. The intermediate transfer belt 61 is, for example, an endless belt composed of a film having a thickness of approximately 100 μm to 150 μm.

Transfer of the toner images from the photosensitive drums 3 to the intermediate transfer belt 61 is performed by the intermediate transfer rollers 64 that are in contact with a back side of the intermediate transfer belt 61. For transfer of the toner images, a high-voltage transfer bias (a high voltage with the opposite polarity (+) to the charge polarity (−) of the toners) is applied to the intermediate transfer rollers 64. The intermediate transfer rollers 64 are rollers in which a metal (stainless steel, for example) shaft having a diameter of 8 mm to 10 mm is used as a base and the surface of the shaft is covered with a conductive elastic material (for example, a resin material such as EPDM (ethylene-propylene-diene rubber) or urethane foam). With this conductive elastic material, the intermediate transfer rollers 64 serve as transfer electrodes that uniformly apply a high voltage to the intermediate transfer belt 61. In the present embodiment, roller-shaped transfer electrodes are used as the transfer electrodes. However, it is also possible to use other types of transfer electrodes such as brush-shaped transfer electrodes.

As described above, the toner images that have been made visible in respective hues on the photosensitive drums 3 are layered on top of one another on the intermediate transfer belt 61. Due to the revolving movement of the intermediate transfer belt 61, the layered toner images on the intermediate transfer belt 61 are transferred onto the paper P by a transfer roller 10 constituting a secondary transfer mechanism portion that is disposed at a position where the paper P and the intermediate transfer belt 61 come into contact with each other. However, the configuration of the secondary transfer mechanism portion is not limited to the transfer roller, and a transfer configuration such as a corona charger or a transfer belt can be used as well.

At this time, a voltage (a high voltage with the opposite polarity (+) to the charge polarity (−) of the toners) for transferring the toners onto the paper P is applied to the transfer roller 10 in a state in which a transfer nip is formed between the roller and the intermediate transfer belt 61. The transfer nip is formed between the transfer roller 10 and the intermediate transfer belt 61 by the transfer roller 10 and the intermediate transfer belt drive roller 62 pressing against each other. In order to constantly obtain the transfer nip, either one of the transfer roller 10 and the intermediate transfer belt drive roller 62 is configured as a hard roller composed of a hard material (such as a metal), and the other roller is configured as an elastic roller composed of a soft material (a resin material such as elastic rubber or foam resin).

During transfer of the toner images on the intermediate transfer belt 61 onto the paper P by the transfer roller 10, there are cases where the toners are not completely transferred onto the paper P, leaving residual toner on the intermediate transfer belt 61. The residual toner on the intermediate transfer belt 61 may cause mixing of the color toners in the following processing. For this reason, the residual toner on the intermediate transfer belt 61 is removed and collected by the intermediate transfer belt cleaning unit 65. Specifically, the intermediate transfer belt cleaning unit 65 is provided with a cleaning member (a cleaning blade, for example) that is in contact with the intermediate transfer belt 61. The idler roller 63 supports the intermediate transfer belt 61 from an inner side (the back side), and the cleaning member is in contact with the intermediate transfer belt 61 in such a manner that the cleaning member presses the belt against the idler roller 63 from an outer side.

The paper feed tray 81 is a tray for storing beforehand paper P onto which an image is to be formed (printed), and is provided below the exposure unit 1 in the apparatus main body 110. Moreover, paper P onto which an image is to be formed (printed) is placed in the manual paper feed tray 82. The paper discharge tray 91 is provided above the image forming portion 102 in the apparatus main body 110, and paper P on which an image has been formed (printed) is accumulated facedown in this tray.

Moreover, the apparatus main body 110 is provided with the main transport path 76 for conveying paper P fed from the paper feed tray 81 and the manual paper feed tray 82 to the paper discharge tray 91 via the transfer roller 10 and the fixing unit 7. Pickup rollers 11*a* and 11*b*, a plurality of (here, a first and a second) transport rollers 12*a* and 12*b*, registration rollers 13, the transfer roller 10, and a heat roller 71 and a pressure roller 72 of the fixing unit 7 are disposed in the vicinity of the main transport path 76. A plurality of (here, a third and a fourth) transport rollers 12*c* and 12*d* are disposed in the vicinity of the reverse transport path 77.

The first to fourth transport rollers 12*a* to 12*d* are small rollers for promoting and assisting transport of paper P. Moreover, the pickup roller 11*a* is provided in the vicinity of a paper supply side of the paper feed tray 81 and picks up and supplies paper P sheet-by-sheet from the paper feed tray 81 to the main transport path 76. Similarly, the pickup roller 11*b* is provided in the vicinity of a paper supply side of the manual paper feed tray 82 and picks up and supplies paper P sheet-by-sheet from the manual paper feed tray 82 to the main transport path 76.

Moreover, the registration rollers 13 temporarily hold paper P during transport through the main transport path 76. Then, the registration rollers 13 transport the paper P to the transfer roller 10 at the timing when a leading end of a toner image on the intermediate transfer belt 61 and a downstream side end (hereinafter referred to as a "leading end P1") in the first transport direction Y1 (one of the transport direction Y) of the paper P are aligned.

The fixing unit 7 is for fixing an unfixed toner image onto the paper P and includes the heat roller 71 and the pressure roller 72, which act as fixing rollers. The heat roller 71, when driven to rotate, transports the paper P in conjunction with the rotated pressure roller 72 while sandwiching the paper P therebetween. Moreover, the heat roller 71 is heated by a heater 71*a* provided inside and is maintained at a predetermined fixing temperature based on a signal from a temperature detector 71*b*. The heat roller 71 heated by the heater 71*a*, in conjunction with the pressure roller 72, bonds a multi-color toner image that has been transferred onto the paper P to the paper P by heat and pressure, whereby the multi-color toner image is fused, mixed, pressed against the paper P, and thus fixed to the paper P by heat.

Transport Path

Figure 2:
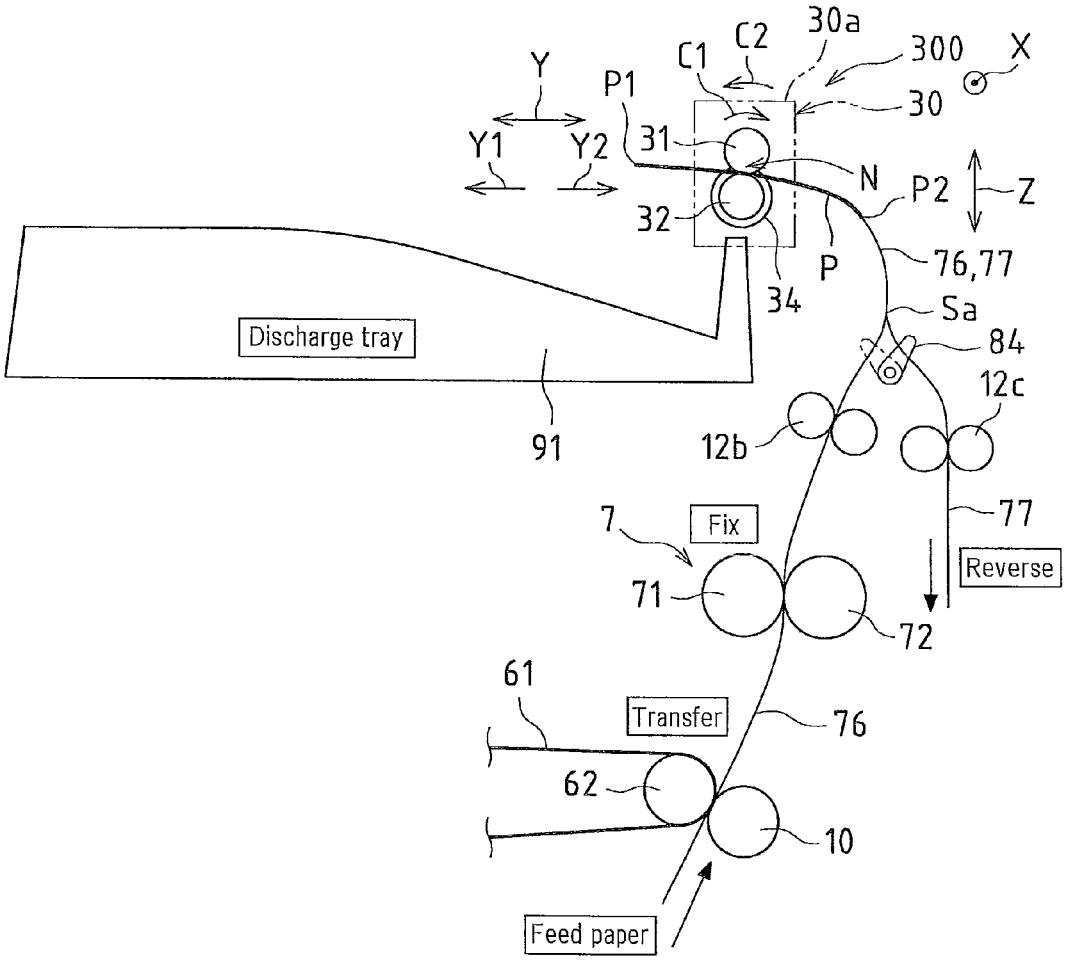
FIG. 2 is a schematic cross-sectional view illustrating a transport path in the image forming apparatus shown in FIG. 1.

FIG. 2 is a schematic cross-sectional view illustrating the transport paths 76 and 77 in the image forming apparatus 100 shown in FIG. 1.

As shown in FIGS. 1 and 2, the image forming apparatus 100 includes, as described above, the main transport path 76 and the reverse transport path 77 as transport paths through which the paper P is transported, and is configured such that the sheet is transported based on the central position thereof. The reverse transport path 77 is curved along the transport direction Y, and constitutes a curved transport path.

The main transport path 76 is a transport path for transporting the paper P between the paper feed portion 80 and a sheet transport portion 30 in the sheet transport apparatus 300.

The reverse transport path 77 is a transport path through which the paper P is transported in a second transport direction Y2 that is opposite to the first transport direction Y1, and is configured to be a transport path that is connected to a connection portion Sb (see FIG. 1) to the main transport path 76, the connection portion Sb being between the image forming portion 102 and the paper feed portion 80, passing through a part of the main transport path 76 from the sheet transport apparatus 300 to a branching portion Sa between the fixing unit 7 and the sheet transport apparatus 300. Accordingly, the transport path between the sheet transport apparatus 300 and the branching portion Sa is common to the main transport path 76 and the reverse transport path 77.

A branching claw 84 is arranged in the branching portion Sa. The branching claw 84 is configured to take a first posture (posture indicated by the solid line in FIG. 2) for guiding the paper P from the fixing unit 7 to the sheet transport apparatus 300, and a second posture (posture indicated by the dashed double-dotted line in FIG. 2) for guiding the paper P that is transported in the second transport direction Y2, which is the opposite direction to the first transport direction Y1, due to reverse rotation (rotation in the direction of arrow C2 in FIG. 2) of first discharge rollers 31 and second discharge rollers 32 described below in the sheet transport apparatus 300, to the reverse transport path 77 side.

In the image forming apparatus 100 configured as described above, the paper P supplied from the paper feed trays 81 and 82 is transported to the registration rollers 13 by the first transport rollers 12*a* disposed along the main transport path 76, and transported by the transfer roller 10 at a timing when the leading end P1 of the paper P and the leading end of the toner image on the intermediate transfer belt 61 are aligned, and thereby the toner image is transferred onto the paper P. Thereafter, the paper P passes through the fixing unit 7 where unfixed toner on the paper P is fused and fixed by heat.

When an image is printed on one side of the paper P, the branching claw 84 is set to the first posture, and the paper P conveyed from the fixing unit 7 is transported by the first discharge rollers 31 and the second discharge rollers 32 that are rotated forward (rotated in the direction of arrow C1 in FIG. 2) via the second transport rollers 12*b*, and is discharged onto the discharge tray 91 by the first discharge rollers 31 and the second discharge rollers 32.

Also, when printing is performed on both sides of the paper P, first, the branching claw 84 is set to the first posture, and the leading end P1 side of the paper P that has passed through the fixing unit 7 is temporarily transferred to the outside by the first discharge rollers 31 and the second discharge rollers 32. Then, after the upstream side end (hereinafter referred to as a "trailing end") P2 in the first transport direction Y1 of the paper P has passed through the branching portion Sa as a result of the paper P having been transferred by the first discharge rollers 31 and the second discharge rollers 32, the branching claw 84 is set to the second posture. After the branching claw 84 is set to the second posture, the first discharge rollers 31 and the second discharge rollers 32 are rotated in reverse. As a result of the first discharge rollers 31 and the second discharge rollers 32 being rotated in reverse, the paper P is transported in the second transport direction Y2 (transported through the switchback operation), and transported along the reverse transport path 77 by the third and fourth transport rollers 12*c* and 12*d* to the connection portion Sb on the upstream side of the registration rollers 13. By transporting the paper P on the reverse transport path 77, the front and back sides of the paper P transported to the connection portion Sb are reversed. Then, the paper P transported to the transfer nip via the registration rollers 13 is, after the printing is performed on its back side, transported by the first discharge rollers 31 and the second discharge rollers 32 that are rotated forward, and is discharged onto the discharge tray 91. Note that the posture of the branching claw 84 is changed from the second posture to the first posture after the paper P has been transported in the second transport direction Y2 and the leading end P1 side of the paper P has passed the branching claw 84.

Sheet Transport Apparatus

Figure 3:
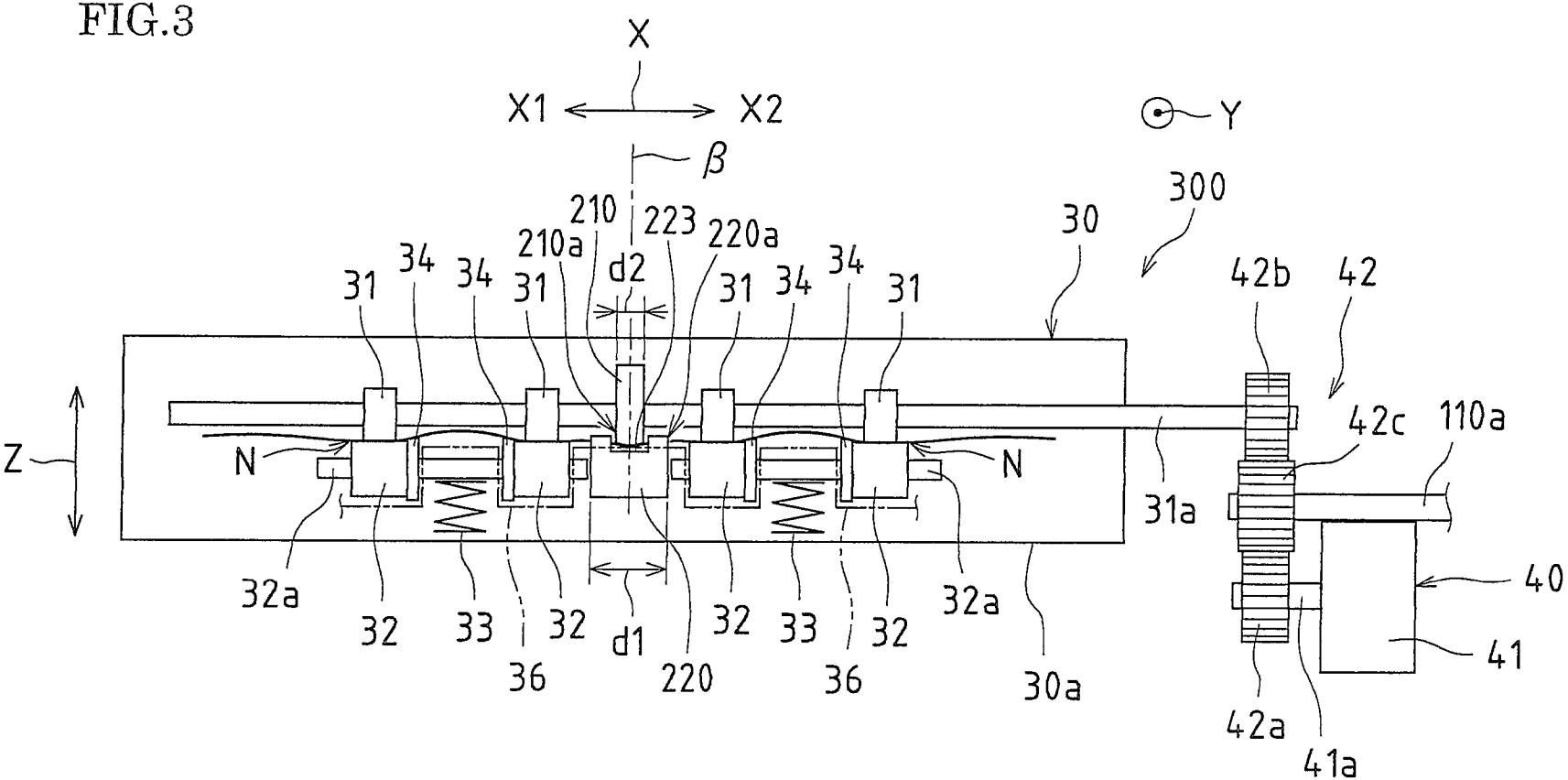
FIG. 3 is a schematic side view of the sheet transport apparatus of the image forming apparatus shown in FIG. 1 as seen from the first transport direction of paper.

FIG. 3 is a schematic side view of the sheet transport apparatus 300 of the image forming apparatus 100 shown in FIG. 1 as seen from the first transport direction Y1 of the paper P. Also, FIG. 4 is a schematic cross-sectional view of the sheet transport apparatus 300 of the image forming apparatus 100 shown in FIG. 1 as seen from an orthogonal direction X (axis line direction) that is orthogonal to the first transport direction Y1 and the second transport direction Y2, and conforms to the paper surface.

Figure 4:
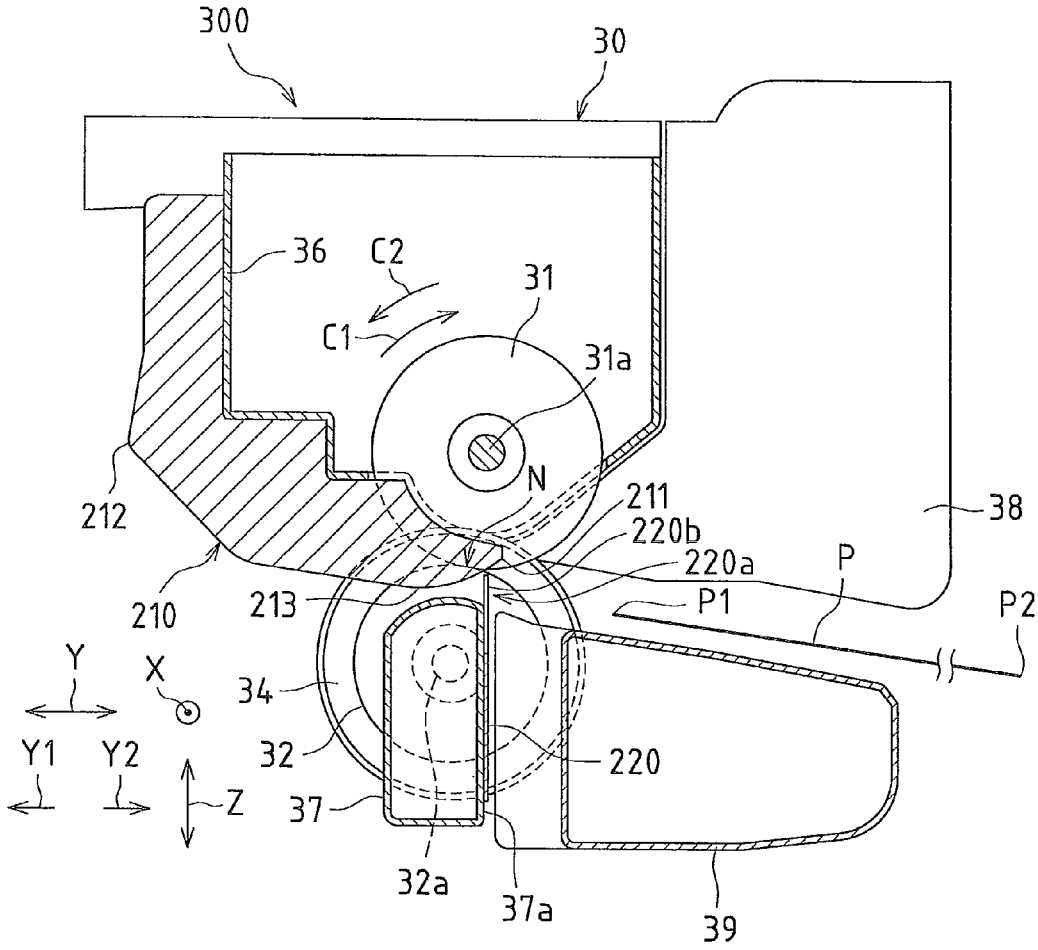
FIG. 4 is a schematic cross-sectional view of the sheet transport apparatus of the image forming apparatus shown in FIG. 1 as seen from an orthogonal direction (axis line direction) that is orthogonal to the first transport direction and second transport direction and conforms to the paper surface.

As shown in FIGS. 2 to 4, the sheet transport apparatus 300 according to the present embodiment includes the sheet transport portion 30 that transports the paper P and a rotation drive portion 40 (see FIG. 3). The sheet transport portion 30 in the present embodiment is configured to transport the paper P in a substantially horizontal direction or slightly diagonally upward. Note that the sheet transport portion 30 may be configured to transport the paper P diagonally downward.

The sheet transport portion 30 includes, as a pair of transport rollers that are driven to rotate and thereby transport the paper P while holding the paper P therebetween, a plurality of (here, four) first discharge rollers (an example of the first transport roller) 31 and a plurality of (here, four) second discharge rollers (an example of second transport roller) 32. The number of the first discharge rollers 31 and the second discharge rollers 32 are the same. The first discharge rollers 31 have the same diameter, and all of them are arranged on the same axis. The second discharge rollers 32 have the same diameter, and are arranged on the same axis in opposition to the first discharge rollers 31. The sheet transport portion 30 transports the paper P while holding the paper P between the first discharge rollers (drive rollers) 31 that are driven to rotate, and the second discharge rollers (idler rollers) 32 that are rotated due to the rotation of the first discharge rollers 31. Specifically, the sheet transport portion 30 transports the paper P in the first transport direction Y1 toward the discharge tray 91 when the first discharge rollers 31 and the second discharge rollers 32 are rotated forward, and it transports the paper P in the second transport direction Y2 toward the reverse transport path 77 when the first discharge rollers 31 and the second discharge rollers 32 are rotated in reverse.

The sheet transport portion 30 further includes a drive roller shaft 31*a* and idler roller shafts 32*a*. The first discharge rollers 31 are fixed to the drive roller shaft 31*a*. The second discharge rollers 32 are fixed to the idler roller shafts 32*a* in opposition to the first discharge rollers 31. Also the sheet transport portion 30 further includes biasing members 33 (here, helical springs) that bias the second discharge rollers 32 toward the first discharge rollers 31 (see FIG. 3).

The first discharge rollers 31, the second discharge rollers 32 and the biasing members 33 are provided on a body frame 30*a* (see FIGS. 2 and 3) of the sheet transport portion 30, and one end of the drive roller shaft 31*a* on which the first discharge rollers 31 are provided protrudes in the orthogonal direction X from the main body frame 30*a* of the sheet transport portion 30 to the outside.

Here, a single drive roller shaft 31*a* is used, and is provided in the main body frame 30*a* of the sheet transport portion 30 so as to be capable of rotating about its axis line with respect to a first covering member 36 (see FIG. 4) that covers the drive roller shaft 31*a*.

In this case, a plurality of (here, two) idler roller shafts 32*a* are disposed in line in the orthogonal direction X, and a plurality of (here, two) second discharge rollers 32 are fixed to each of them. Each idler roller shaft 32*a* is provided in the main body frame 30*a* of the sheet transport portion 30 such that the second discharge rollers 32 are in opposition to the corresponding first discharge rollers 31, and so as to be capable of rotating about the axis line with respect to a second covering member 37 (see FIGS. 3 and 4) that covers the idler roller shafts 32*a*, and capable of moving back and forth in a perpendicular direction Z (here, the vertical direction) that is orthogonal to the first transport direction Y1, the second transport direction Y2 and the orthogonal direction X. The sheet transport portion 30 is configured such that the paper P is transported in a state in which it is pressed by the second discharge rollers 32 in a nip portion N between the first discharge rollers 31 and the second discharge rollers 32, while being held therebetween.

Specifically, the biasing members 33 are configured to bias the second discharge rollers 32 toward the first discharge rollers 31, and in this case, are disposed between the second discharge rollers 32 and the main body frame 30*a* of the sheet transport portion 30. Specifically, the biasing members 33 are disposed between the idler roller shafts 32*a* to which the second discharge rollers 32 are fixed, and a portion of the main body frame 30*a* of the sheet transport portion 30 that is in the position opposite to the first discharge rollers 31 with respect to the idler roller shafts 32*a*. Note that a pressing force that is applied to the first discharge rollers 31 by the second discharge rollers 32 due to the biasing members 33 is approximately a pressure under which proper transport of the paper P is not hindered.

The sheet transport portion 30 further includes a plurality of (here, four) bending rollers 34 that each act as a bending member for bending the paper P by corrugating the paper P in the orthogonal direction X. The bending rollers 34 are arranged on the same axis as that of the discharge rollers (here, the second discharge rollers 32) of at least one of the first discharge rollers 31 and the second discharge rollers 32, and have a diameter larger than that of the second discharge rollers 32. Note that the bending rollers 34 may be arranged on the same axis as that of one of the first discharge rollers 31 and the second discharge rollers 32, or may be arranged on the same axes as that of both the first discharge rollers 31 and the second discharge rollers 32. In the case where the bending rollers 34 are provided on both the first discharge rollers 31 and the second discharge rollers 32, the bending rollers 34 on the first discharge rollers 31 side and those on the second discharge rollers 32 side are arranged so as not to overlap each other in the orthogonal direction X.

In this manner, when the sheet transport portion 30 transports the paper P, it provides the paper P with a shape corrugated in the orthogonal direction X using the bending rollers 34, thereby bending the paper P.

Specifically, the bending rollers 34 are provided on the second discharge rollers 32 in an end portion thereof on one side X1 or the other side X2 in the orthogonal direction X. Note that the bending rollers 34 may be provided on the idler roller shafts 32*a*.

Here, one bending roller 34 may be disposed for each second discharge roller 32 or at an interval of two or more second discharge rollers 32. Alternatively, a plurality of bending rollers 34 may be arranged for each second discharge roller 32 or at an interval of two or more second discharge rollers 32. Also, any combination of these arrangement configurations may be used. In the present embodiment, two bending rollers 34 are provided between each second discharge roller 32 on the outer end and the second discharge roller 32 inward thereof.

The rotation drive portion 40 drives the drive roller shaft 31*a* on which the first discharge rollers 31 are provided to rotate, and includes a transport drive motor 41 (here, stepping motor) and a drive transmission mechanism 42 for transmitting rotational drive from the transport drive motor 41 to the drive roller shaft 31*a*.

The transport drive motor 41 is provided in the apparatus main body 110 such that a rotation shaft 41*a* thereof extends in the orthogonal direction X.

Here, the drive transmission mechanism 42 is constituted by a gear train in which a plurality of gears are combined, and includes a drive gear 42*a*, a roller gear 42*b* and an intermediate gear 42*c*.

The drive gear 42*a* is linked to the rotation shaft 41*a* of the transport drive motor 41. The roller gear 42*b* is linked to an end portion of the drive roller shaft 31*a*, the end portion protruding in the orthogonal direction X from the main body frame 30*a* of the sheet transport portion 30 to the outside. The intermediate gear 42*c* is supported by a rotation shaft 110*a* fixed to the apparatus main body 110 so as to be capable of rotation, and is engaged with the drive gear 42*a* and the roller gear 42*b*.

The transport drive motor 41 is electrically connected to an output system of a control portion (not shown in the drawings) such that a drive signal (ON signal) or a drive stop signal (OFF signal) from the control portion is obtained. The control portion can drive the first discharge rollers 31 to rotate in one direction C1 (the first transport direction Y1, see FIGS. 2 and 4) or the other direction C2 (the second transport direction Y2, see FIGS. 2 and 4), by sending a rotation instruction signal instructing the rotational direction to the transport drive motor 41 so as to drive the transport drive motor 41.

Here, a discharge configuration is constituted by a configuration that includes the first discharge rollers 31 and second discharge rollers 32, the rotation drive portion 40, and a control configuration of the control portion (not shown in the drawings) that controls the rotation drive portion 40 so as to transport the paper P in the first transport direction Y1 and discharge the paper P onto the discharge tray 91. Also, a transport configuration is constituted by a configuration that includes the first discharge rollers 31 and second discharge rollers 32, the rotation drive portion 40, and a control configuration of the control portion (not shown in the drawings) that controls the rotation drive portion 40 so as to transport the paper P in the second transport direction Y2 toward the reverse transport path 77.

The sheet transport apparatus 300 includes a first sheet transport guide 38 and a second sheet transport guide 39 (see FIG. 4), which are provided opposing each other in the perpendicular direction Z with a gap provided therebetween, on the upstream side in the first transport direction Y1 of the nip portion N between the first discharge rollers 31 and the second discharge rollers 32. The transported paper P is guided to a portion between the first sheet transport guide 38 and the second sheet transport guide 39, and then to the nip portion N.

Also, the sheet transport apparatus 300 includes a bending guide portion 210 (see FIGS. 3 and 4) that serves as a bending member that corrugates the paper P in the orthogonal direction X, thereby bending the paper P. Note that the bending guide portion 210 is not shown in FIGS. 1 and 2.

Specifically, the bending guide portion 210 is provided on the first covering member 36, and has a curved shape including a curved surface in which an upstream side end 211 in the first transport direction Y1 and a downstream side end 212 in the first transport direction Y1 (upstream side end in the second transport direction Y2) are positioned on one side (here, the upper side) in the perpendicular direction Z of the nip portion N between the first discharge rollers 31 and the second discharge rollers 32, and also a tip 213 (vertex portion) on the side coming into contact with the paper P in the perpendicular direction Z is positioned on the other side (here, the lower side) in the perpendicular direction Z of the nip portion N. Also, the upstream side end 211 of the bending guide portion 210 is disposed on the upstream side in the first transport direction Y1 relative to the nip portion N between the first discharge rollers 31 and the second discharge rollers 32, and the tip 213 of the bending guide portion 210 is disposed on the downstream side in the first transport direction Y1 relative to the nip portion N between the first discharge rollers 31 and the second discharge rollers 32. In the present embodiment, the bending guide portion 210 and the first covering member 36 are formed with resin, and the bending guide portion 210 and the first covering member 36 are formed as a single body.

In the sheet transport apparatus 300 described above, as shown in FIGS. 3 and 4, a restriction member 220 is provided for restricting, in the perpendicular direction Z, corrugations in the paper P bent by, out of the bending rollers 34 and the bending guide portion 210, the bending guide portion 210. Here, the restriction member 220 is provided in the sheet transport portion 30. Note that the restriction member 220 is not shown in FIGS. 1 and 2. With this restriction member 220, when the paper P transported through the switchback operation is guided to the reverse transport path 77 (see FIG. 2), it is possible to suppress an abnormal sound that occurs when the paper P corrugated in the orthogonal direction X by the bending rollers 34 and the bending guide portion 210 is forcibly bent along the reverse transport path 77 curved in the transport direction Y, and is thereby restored from the corrugated state.

Specifically, the restriction member 220 is provided on the upstream side in the first transport direction Y1 of the tip 213 (position thereof) in the perpendicular direction Z of the bending guide portion 210. Also, in a state in which pressure from the paper is not applied to the restriction member 220 and thus it is not deformed as shown in FIG. 4, the restriction member 220 is provided on the upstream side in the first transport direction Y1 of the nip portion N between the first discharge rollers 31 and the second discharge rollers 32.

In the present embodiment, since the restriction member 220 that restricts corrugations in the paper P bent by the bending guide portion 210 in the perpendicular direction Z is provided on the upstream side in the first transport direction Y1 (here, the direction in which the paper P is discharged onto the discharge tray 91) of the position of the tip 213 in the perpendicular direction Z of the bending guide portion 210, corrugations formed in the paper P by the bending guide portion 210 can be maintained in the paper P that is transported (here, discharged) from the restriction member 220 in the first transport direction Yl, whereas corrugations formed in the paper P by the bending guide portion 210 can be reduced in the paper P that is transported from the restriction member 220 in the second transport direction Y2 (here, the direction toward the reverse transport path 77 curved in the transport direction Y). In this manner, it is possible to suppress occurrence of the problem relating to corrugations formed in the paper P by the bending rollers 34 and the bending guide portion 210 (particularly, an abnormal sound that occurs when the paper P is transported to the reverse transport path 77), while securing high stacking quality of the paper P.

In the present embodiment, the restriction member 220 is provided opposing the bending guide portion 210 in at least one of the orthogonal direction X and the perpendicular direction Z (here, at a central portion in the orthogonal direction X). In this manner, with respect to the paper P transported in the second transport direction Y2 from the restriction member 220, corrugations in a position corresponding to the position of the bending guide portion 210 can be reliably reduced.

Incidentally, if the restriction member 220 is provided on the downstream side in the first transport direction Y1 of the nip portion N, the transport of the paper P transported in the first transport direction Y1 from the sheet transport portion 30 to the outside (here, discharged onto the discharge tray 91) as in the present embodiment is obstructed by the restriction member 220 that is provided on the downstream side in the first transport direction Y1 of the nip portion N, and the trailing end portion P2 of the paper P is caught by the restriction member 220 (for example, the trailing end P2 runs onto the restriction member 220), and the paper P is not discharged onto the discharge tray 91, or stacking quality of the paper P readily deteriorates.

Accordingly, in the present embodiment, the restriction member 220 is provided on the upstream side in the first transport direction Y1 of the nip portion N. In this manner, it is possible to prevent the restriction member 220 from inhibiting the force with which the paper P is transported (here, discharged onto the discharge tray 91) from the sheet transport portion 30 to the outside in the first transport direction Y1, and it is thereby possible to reliably discharge the paper P onto the discharge tray 91 and prevent deterioration of stacking quality of the paper P.

Also, in the present embodiment, the restriction member 220 is a flexible member that has elasticity that is smaller than the force with which the sheet transport portion 30 transports the paper P.

In this manner, with the restriction member 220 formed as a flexible member, it is possible for the restriction member 220 to be bent allowing for an appropriate elasticity and thereby restrict corrugations in the paper P, while keeping transportability of the paper P bent by the bending guide portion 210.

Also, in the present embodiment, the restriction member 220 is formed as a sheet-shaped flexible member. Specifically, the restriction member 220 is disposed crossing the transport path of the paper P (for example, substantially at a right angle with respect to the transported paper P). Specifically, the restriction member 220 formed as a sheet-shaped flexible member is attached to a side face 37*a* on the upstream side in the first transport direction Y1 of the second covering member 37 (see FIG. 4) provided in the main body frame 30*a* of the sheet transport portion 30 with a tip portion 220*a* projecting toward the transport path side, such that a plane 220*b* on the upstream side in the first transport direction Y1 (see FIG. 4) comes into contact with the leading end P1 of the transported paper P. Also, the tip portion 220*a* of the restriction member 220 is formed in a shape having a pair of members (see a first opposing portion 221 and a second opposing portion 222 described below), and as shown in FIG. 3, the bending guide portion 210 is provided between the pair of members of the tip portion 220*a*.

In this manner, since the restriction member 220 is formed as a sheet-shaped flexible member, it is possible to readily achieve both transportability of the paper P and an effect of restricting corrugations in the paper P with an inexpensive and simple structure.

Incidentally, when the restriction member 220 formed as a flexible member comes into contact with the paper P for restricting corrugations in the paper P bent by the bending guide portion 210, a sound may be generated by the restriction member 220 and the paper P rubbing against each other. This is particularly noticeable when an image (toner image) is formed on the side of the paper P that comes into contact with the restriction member 220.

Accordingly, in the present embodiment, at least a portion of the restriction member 220 coming into contact with the sheet is formed with a fluororesin (specifically, polytetrafluoroethylene). Since the fluororesin generally has a friction coefficient that is much lower than that of the paper P, the sound caused by the restriction member 220 and the paper P rubbing against each other can be reduced or eliminated.

Specifically, the restriction member 220 formed as a sheet-shaped flexible member is a Teflon® film made of a fluororesin. In such a configuration, it is possible to reduce or eliminate a sound caused by the restriction member 220 and the paper P rubbing against each other, while readily achieving both transportability of the paper P and an effect of restricting corrugations in the paper P, with an inexpensive and simple structure.

Note that in the present embodiment, the restriction member 220 formed as a sheet-shaped flexible member is made of a fluororesin, the restriction member 220 may be formed by coating an elastic body with a fluororesin.

Incidentally, from the viewpoint of facilitating restriction of corrugations in the paper P bent by the bending guide portion 210, it is preferable that the restriction member 220 overlaps the bending guide portion 210 in the orthogonal direction X. However, in this case, even if the restriction member 220 is elastically deformed due to transport of the paper P in the first transport direction Y1, unless the path for the paper P is secured, transport of the paper P is obstructed by the restriction member 220, thereby causing a jam (paper jam).

Accordingly, in the present embodiment, the restriction member 220 is configured to overlap the bending guide portion 210 in the orthogonal direction X (see FIG. 4), and also to allow for elastic deformation thereof due to transport of the paper P in the first transport direction Y1 (see below-described FIG. 5), thereby securing the path for the paper P. In this manner, it is possible to prevent the restriction member 220 from obstructing transport of the paper P, and thereby occurrence of a jam (paper jam) can be prevented.

Figure 5B:
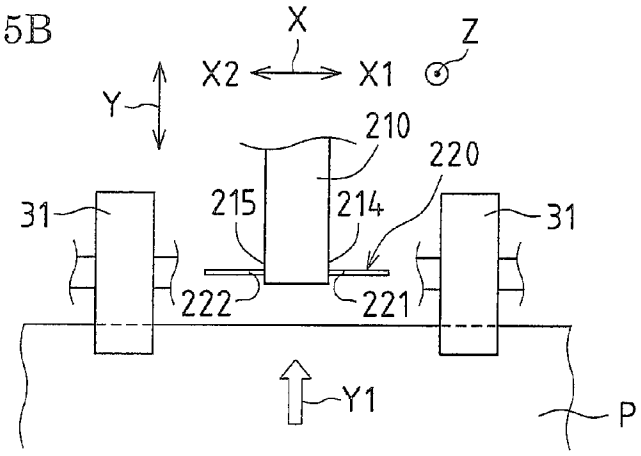
FIGS. 5A and 5B are a schematic side view and a schematic plan view, respectively, showing a state of the restriction member when the paper is not passing the restriction member.
Figure 5D:
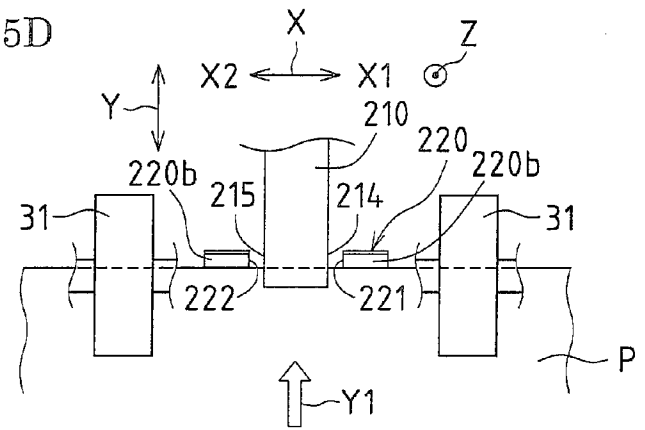
FIGS. 5C and 5D are a schematic side view and a schematic plan view, respectively, showing a state of the restriction member immediately after the paper has begun passing the restriction member.
Figure 5A:
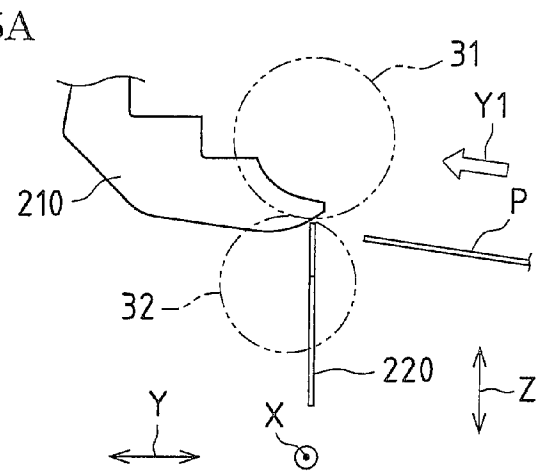
Figure 5C:
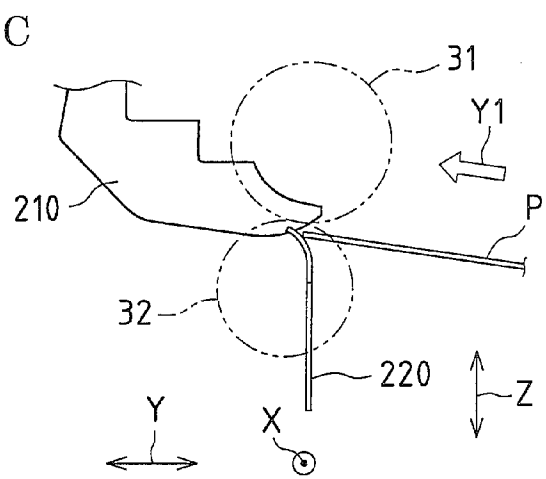
Figure 6:
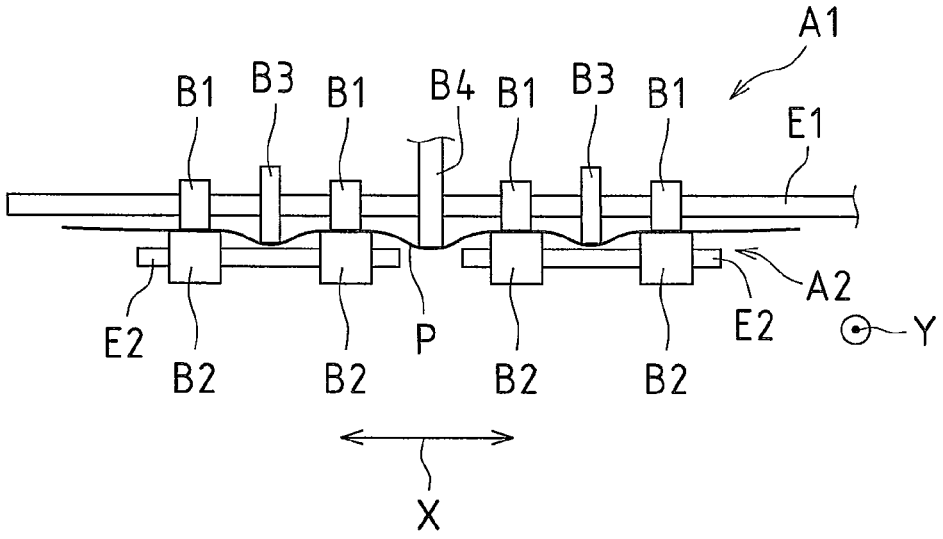
FIG.6 Prior Art
FIG. 6 is a diagram illustrating an example of a conventional sheet transport apparatus, in which bending rollers and a bending guide portion, each serving as a bending member, are provided, and is a schematic side view of a transportation state of a sheet as seen from the transport direction thereof.
Figure 7:
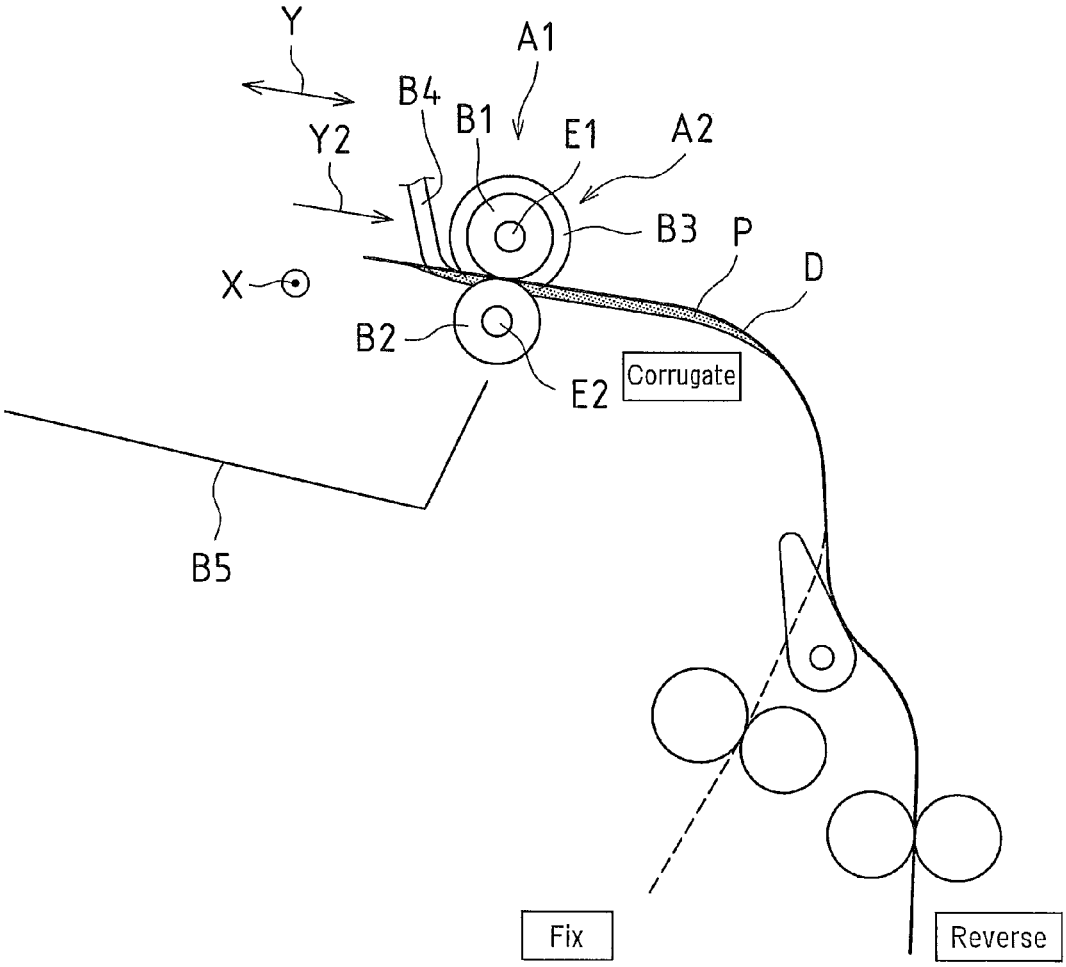
FIG.7 Prior Art
FIG. 7 is a schematic cross-sectional view of a state in which, in an example of the sheet transport apparatus, a sheet corrugated in the orthogonal direction that is orthogonal to the transport direction and conforms to the sheet surface is transported in a curved transport path that is curved in the transport direction, as seen from the orthogonal direction.

FIG. 5 includes FIGS. 5A, 5B, 5C and 5D, each schematically illustrating a configuration in which although the restriction member 220 overlaps the bending guide portion 210 in the orthogonal direction X, the path for the paper P is secured by allowing for elastic deformation of the restriction member 220 due to transport of the paper P in the first transport direction Y1. FIGS. 5A and 5B are a schematic side view and a schematic plan view, respectively, each showing a state of the restriction member 220 when the paper P is not passing the restriction member 220, and FIGS. 5C and 5D are a schematic side view and a schematic plan view, respectively, each showing a state of the restriction member 220 immediately after the paper P has begun passing the restriction member 220. Note that in FIGS. 5B and 5D, the second discharge rollers 32 are not shown.

As shown in FIG. 5, the restriction member 220 includes the first opposing portion 221 (see FIG. 5D) that opposes an end face 214 on one side X1 in the orthogonal direction X of the bending guide portion 210 in a contactless manner when it is elastically deformed due to transport of the paper P in the first transport direction Y1 (see FIGS. 5C and 5D), and the second opposing portion 222 (see FIG. 5D) that opposes an end face 215 on the other side X2 in the orthogonal direction X of the bending guide portion 210 in a contactless manner, when the restriction member 220 is elastically deformed due to transport of the paper P in the first transport direction Y1 (see FIGS. 5C and 5D).

Specifically, when the paper P is not passing the restriction member 220 (see FIGS. 5A and 5B), the first opposing portion 221 does not oppose the end face 214 on the one side X1 of the bending guide portion 210, and the second opposing portion 222 does not oppose the end face 215 on the other side X2 of the bending guide portion 210 (see FIGS. 5A and 5B). In contrast, immediately after the paper P has begun passing the restriction member 220, the first opposing portion 221 opposes the end face 214 on the one side X1 of the bending guide portion 210 in a contactless manner, and the second opposing portion 222 opposes the end face 215 on the other side X2 of the bending guide portion 210 in a contactless manner (see FIGS. 5C and 5D). In this manner, the path for transporting the paper P in the first transport direction Y1 can be reliably secured.

Specifically, a width d1 (see FIG. 3) in the orthogonal direction X of the tip portion 220*a* on the side coming into contact with the paper P of the restriction member 220 is larger than a width d2 (see FIG. 3) in the orthogonal direction X of a tip portion 210*a* on the side coming into contact with the paper P of the bending guide portion 210. The restriction member 220 has a recessed shape that includes a recessed portion 223 such that the tip portion 220*a* does not come into contact with the tip portion 210*a* of the bending guide portion 210 when the restriction member 220 is elastically deformed due to transport of the paper P in the first transport direction Y1.

Incidentally, from the viewpoint of reduction in the size of apparatuses and various constituent elements such as detection means (specifically, a discharge switch (not shown in the drawings)) provided on the upstream side in the first transport direction Y1 of the nip portion N between the first discharge rollers 31 and the second discharge rollers 32, the tip portion of the bending guide portion may be provided protruding from below on the downstream side in the first transport direction Y1 of the nip portion N. In this case, the transported paper P is corrugated in the orthogonal direction X from below by the bending guide portion, thereby bending the paper P. In this manner, when the bending guide portion corrugates the transported paper P in the orthogonal direction X from below and bends without breaking the paper P, in the case where the sheet transport portion 30 is configured to transport the paper P in a substantially horizontal direction or slightly upward (see the present embodiment), the transport of the paper P in first transport direction Y1 from the sheet transport portion 30 to the outside (here, discharged onto the discharge tray 91) is obstructed by the tip portion of the bending guide portion that is provided on the downstream side in the first transport direction Y1 of the nip portion N and that bends without breaking the paper P by corrugating the paper P from below. Specifically, the trailing end portion P2 of the paper P is caught by the tip portion of the bending guide portion (for example, the trailing end portion P2 runs on the tip portion), and consequently the paper P is not discharged onto the discharge tray 91, or stacking quality of the paper P readily deteriorates.

Accordingly, in the present embodiment, the bending guide portion 210 is configured such that the tip 213 is provided on the downstream side in the first transport direction Y1 of the nip portion N, and corrugates the transported paper P in the orthogonal direction X from above so as to bend the paper P, and the restriction member 220 is configured to restrict corrugations in the paper P from below. Specifically, the bending guide portion 210 has a curved shape having a curved surface raised downward such that the upstream side end 211 in the first transport direction Y1 and the downstream side end 212 in the first transport direction Y1 are positioned higher than the nip portion N, and the tip 213 in the perpendicular direction Z is positioned lower than the nip portion N. The restriction member 220 extends upward (specifically, substantially vertically) to a higher position than the tip 213 of the bending guide portion 210, such that the tip portion 220*a* is a free end.

As in the present embodiment, even if the sheet transport portion 30 is configured to transport the paper P in a substantially horizontal direction or slightly upward, and the tip 213 of the bending guide portion 210 is provided on the downstream side in the first transport direction Y1 of the nip portion N, by adopting a configuration in which the bending guide portion 210 bends without breaking the paper P transported in the sheet transport portion 30 by corrugating the paper P from above, it is possible to prevent the bending guide portion 210 from inhibiting the force with which the paper P is transported in the first transport direction Y1 (here, discharged onto the discharge tray 91) from the sheet transport portion 30 to the outside. In this manner, the paper P can be reliably discharged onto the discharge tray 91, and deterioration of stacking quality of the paper P can be prevented.

Also, in the present embodiment, the bending guide portion 210 is arranged in the central position of the transported paper P in the orthogonal direction X (see 6 in FIG. 3). In this manner, corrugations in the paper P can be reduced with a restriction member 220 that restricts corrugations in the paper P that has been bent by the bending guide portion 210 arranged in the central position, and in this manner, mainly, it is possible to suppress occurrence of problems relating to corrugations in the paper P formed by the bending rollers 34 and the bending guide portion 210, while securing high stacking quality of the paper P such as small size paper, an envelope and the like.

Note that although the bending guide portion 210 is provided in the central position in the orthogonal direction X in the present embodiment, the bending guide portion 210 may be provided in at least one position between the bending rollers 34.

Also, in the present embodiment, the restriction member 220 restricts corrugations in the paper P bent by, out of the bending rollers 34 and the bending guide portion 210, the bending guide portion 210. However, corrugations in the paper P bent by the bending rollers 34 may be restricted.

Also, although the sheet transport portion 30 is provided in a position where the paper P on which an image is formed is transported, problems relating to corrugations in an original can be similarly prevented by providing the sheet transport portion 30 in a position where an original on which image reading performed is transported.

The present invention may be embodied in various other forms without departing from the spirit or essential characteristics thereof. The embodiments disclosed in this application are to be considered in all respects as illustrative and not limiting. The scope of the invention is indicated by the appended claims rather than by the foregoing description, and all modifications or changes that come within the meaning and range of equivalency of the claims are intended to be embraced therein.

What is claimed is:

1. A sheet transport apparatus comprising:

a sheet transport portion that transports a sheet in a first transport direction and a second transport direction that is opposite to the first transport direction;

a bending member that bends without breaking the sheet by corrugating the sheet in an orthogonal direction that is orthogonal to the transport direction of the sheet and conforms to a surface of the sheet; and a restriction member that restricts, in a perpendicular direction that is orthogonal to both the first transport direction and the second transport direction, and the orthogonal direction, a corrugation in the sheet bent by the bending member, wherein the restriction member is provided on an upstream side in the first transport direction of the bending member, wherein the restriction member is provided on the upstream side in the first transport direction of a tip in the perpendicular direction of the bending member, and wherein the sheet transport portion comprises a pair of transport rollers for transporting the sheet, and is configured to transport the sheet in a horizontal direction, diagonally upward or diagonally downward, the tip of the bending member is provided on a downstream side in the first transport direction of a nip portion of the pair of transport rollers, and the bending member is configured to bend a transported sheet by corrugating the transported sheet in the orthogonal direction from above, and the restriction member is configured to restrict the corrugation from below the sheet.

2. The sheet transport apparatus according to claim 1, wherein the restriction member is provided opposing the bending member in at least one of the orthogonal direction and the perpendicular direction.

3. The sheet transport apparatus according to claim 1, wherein the restriction member is provided on the upstream side in the first transport direction of a nip portion of the pair of transport rollers.

4. An image forming apparatus comprising:

the sheet transport apparatus according to claim 1;

a curved transport path provided on a downstream side in the second transport direction of the sheet transport portion of the sheet transport apparatus; and a discharge configuration in which the sheet transport portion transports a sheet in the first transport direction and discharges a sheet to the outside, and a transport configuration in which the sheet transport portion transports a sheet in the second transport direction toward the curved transport path.

5. A sheet transport apparatus comprising:

a sheet transport portion that transports a sheet in a first transport direction and a second transport direction that is opposite to the first transport direction;

a bending member that bends without breaking the sheet by corrugating the sheet in an orthogonal direction that is orthogonal to the transport direction of the sheet and conforms to a surface of the sheet; and a restriction member that restricts, in a perpendicular direction that is orthogonal to both the first transport direction and the second transport direction, and the orthogonal direction, a corrugation in the sheet bent by the bending member, wherein the restriction member is provided on an upstream side in the first transport direction of the bending member wherein the restriction member is a flexible member having elasticity that is smaller than a force with which the sheet transport portion transports the sheet.

6. The sheet transport apparatus according to claim 5, wherein the restriction member is a sheet-shaped flexible member.

7. The sheet transport apparatus according to claim 6, wherein the restriction member formed as a sheet-shaped flexible member is made of a fluororesin.

8. The sheet transport apparatus according to claim 5, wherein at least a portion of the restriction member that comes into contact with the sheet is formed with a fluororesin.

9. The sheet transport apparatus according to claim 5, wherein the restriction member overlaps the bending member in the orthogonal direction, and secures a path for the sheet by allowing for elastic deformation due to transport of the sheet in the first transport direction.

10. The sheet transport apparatus according to claim 9, wherein the restriction member includes a first opposing portion that opposes an end portion of the bending member that is on one side in the orthogonal direction in a contactless manner when the restriction member undergoes elastic deformation due to transport of the sheet in the first transport direction, and a second opposing portion that opposes an end portion of the bending member that is on the other side in the orthogonal direction in a contactless manner when the restriction member undergoes elastic deformation due to transport of the sheet in the first transport direction.

11. An image forming apparatus comprising:

the sheet transport apparatus according to claim 5;

a curved transport path provided on a downstream side in the second transport direction of the sheet transport portion of the sheet transport apparatus; and a discharge configuration in which the sheet transport portion transports a sheet in the first transport direction and discharges a sheet to the outside, and a transport configuration in which the sheet transport portion transports a sheet in the second transport direction toward the curved transport path.

12. A sheet transport apparatus comprising:

a sheet transport portion that transports a sheet in a first transport direction and a second transport direction that is opposite to the first transport direction;

a bending member that bends without breaking the sheet by corrugating the sheet in an orthogonal direction that is orthogonal to the transport direction of the sheet and conforms to a surface of the sheet; and a restriction member that restricts, in a perpendicular direction that is orthogonal to both the first transport direction and the second transport direction, and the orthogonal direction, a corrugation in the sheet bent by the bending member, wherein the restriction member is provided on an upstream side in the first transport direction of the bending member, wherein the sheet transport apparatus comprises a plurality of first transport rollers provided on a same axis, a plurality of second transport rollers that are provided opposing the plurality of first transport rollers and on a same axis, a pair of transport rollers configured to transport the sheet while holding the sheet between the first transport rollers and the second transport rollers that are rotated, a bending roller that is provided on the same axis as that of at least one of the first transport rollers and the second transport rollers, and has a diameter larger than that of the transport rollers provided on the same axis as that of the bending roller, and a bending guide portion provided in a central position of a transported sheet in the orthogonal direction, and the restriction member restricts the corrugation in the sheet bent by the bending guide portion out of the bending roller and the bending guide portion.

13. An image forming apparatus comprising:

the sheet transport apparatus according to claim 12;

a curved transport path provided on a downstream side in the second transport direction of the sheet transport portion of the sheet transport apparatus; and a discharge configuration in which the sheet transport portion transports a sheet in the first transport direction and discharges a sheet to the outside, and a transport configuration in which the sheet transport portion transports a sheet in the second transport direction toward the curved transport path.

* * * * *

UNITED STATES PATENT AND TRADEMARK OFFICE

CERTIFICATE OF CORRECTION

PATENT NO. : 8,523,175 B2
APPLICATION NO. : 13/296430
DATED : September 3, 2013
INVENTOR(S) : Yoshiyuki Kobayashi et al.

It is certified that error appears in the above-identified patent and that said Letters Patent is hereby corrected as shown below:

IN THE CLAIMS:

In claim 1, at column 20, line 65 (immediately below line 64), insert the following additional limitation:

-- wherein at least a portion of the restriction member overlaps the bending member in a vertical direction perpendicular to the orthogonal direction, --.

Signed and Sealed this
Twenty-eighth Day of January, 2014

Michelle K. Lee

Michelle K. Lee
*Deputy Director of the United States Patent and Trademark Office*